US008261587B2

(12) United States Patent
Haviv et al.

(10) Patent No.: US 8,261,587 B2
(45) Date of Patent: Sep. 11, 2012

(54) CYLINDER PROTECTIVE SYSTEM

(75) Inventors: Asher Haviv, Bat-Yam (IL); Eric Torgeman, Natania (IL)

(73) Assignees: Asher Haviv, Bat-Yam (IL); Eric Torgeman, Natania (IL); Moshe Aharon, Bat-Yam (IL)

( * ) Notice: Subject to any disclaimer, the term of this patent is extended or adjusted under 35 U.S.C. 154(b) by 0 days.

(21) Appl. No.: 12/995,676

(22) PCT Filed: Jun. 4, 2009

(86) PCT No.: PCT/IL2009/000560

§ 371 (c)(1),
(2), (4) Date: Dec. 2, 2010

(87) PCT Pub. No.: WO2009/147677

PCT Pub. Date: Dec. 10, 2009

(65) Prior Publication Data

US 2011/0072868 A1 Mar. 31, 2011

(30) Foreign Application Priority Data

Jun. 5, 2008 (IL) ..... 192010
Jul. 16, 2008 (IL) ..... 192858
Aug. 19, 2008 (IL) ..... 193553

(51) Int. Cl.
*E05B 13/00* (2006.01)
*E05B 15/00* (2006.01)
*E05B 17/00* (2006.01)
*E05B 63/00* (2006.01)

(52) U.S. Cl. ..... 70/416; 70/417; 70/420; 70/421; 70/492; 70/493; 70/494; 70/495; 70/496

(58) Field of Classification Search ..... 70/416, 70/417, 420, 421, 492, 493, 494, 495, 496
See application file for complete search history.

(56) References Cited

U.S. PATENT DOCUMENTS 1,422,497 A * 7/1922 Thompson ..... 70/417

(Continued)

FOREIGN PATENT DOCUMENTS

DE 3643188 6/1988

(Continued)

OTHER PUBLICATIONS

International Preliminary Report on Patentability Dated Sep. 8, 2010 From the International Preliminary Examining Authority Re. Application No. PCT/IL2009/000540.

International Preliminary Report on Patentability Dated Jul. 30, 2010 From the International Preliminary Examining Authority Re. Application No. PCT/IL2009/000560.

(Continued)

*Primary Examiner* — Suzanne Barrett
*Assistant Examiner* — David E Sosnowski

(57) ABSTRACT

A substantially burglary-proof lock, comprises a housing formed with a cylindrical bore defining an inner cylindrical surface, and a cylinder within said bore carrying locking elements movable to locking and unlocking positions with respect to said housing, said cylinder having an outer diameter equal to the diameter of said bore so as to be rotatable when the locking elements are in unlocking position with respect to said housing, said cylinder being formed with a keyway for receiving a proper key in order to move said locking elements to their locking and unlocking positions with respect to said housing, characterized in that said cylinder carries at least one insert of a hard material configured, dimensioned and located such as to prevent pull-out of the cylinder from the housing by a pull-out force applied to the cylinder, and/or by drilling through the locking elements.

31 Claims, 12 Drawing Sheets

U.S. PATENT DOCUMENTS

| | | | | |
|---|---|---|---|---|
| 1,422,515 | A | 7/1922 | Augenbraun | |
| 3,780,549 | A | 12/1973 | Schlage | |
| 5,437,176 | A | 8/1995 | Keller | |
| 5,704,234 | A * | 1/1998 | Resch | 70/416 |
| 5,711,506 | A * | 1/1998 | Stillwagon | 70/417 |
| 5,970,760 | A * | 10/1999 | Shen | 70/371 |
| 7,003,994 | B2 * | 2/2006 | Ruan | 70/416 |
| 7,181,938 | B2 * | 2/2007 | Price | 70/417 |
| 2003/0089148 | A1 * | 5/2003 | Ruan | 70/386 |
| 2010/0024499 | A1 * | 2/2010 | Xu et al. | 70/494 |

FOREIGN PATENT DOCUMENTS

| | | | |
|---|---|---|---|
| DE | 4317994 | | 10/1994 |
| DE | 29602680 | | 4/1996 |
| EP | 0161654 | | 11/1985 |
| EP | 0237799 | | 9/1987 |
| FR | 2378925 | | 8/1978 |
| GB | 2298454 | A * | 9/1996 |
| WO | WO 2005/095738 | | 10/2005 |
| WO | WO 2008/015672 | | 2/2008 |
| WO | WO 2009/147660 | | 12/2009 |
| WO | WO 2009/147677 | | 12/2009 |

OTHER PUBLICATIONS

International Search Report and the Written Opinion Dated Sep. 18, 2009 From the International Searching Authority Re.: Application No. PCT/IL2009/000560.

International Search Report and the Written Opinion Dated Dec. 21, 2009 From the International Searching Authority Re.: Application No. PCT/IL2009/000540.

Response Dated Apr. 7, 2010 to Written Opinion of Sep. 18, 2009 From the International Searching Authority Re.: Application No. PCT/IL2009/000560.

Response Dated Mar. 31, 2010 to International Search Report and the Written Opinion of Dec. 21, 2009 From the International Searching Authority Re.: Application No. PCT/IL2009/000540.

Office Action Dated Mar. 22, 2011 From the Israel Patent Office Re. Application No. 191855 and Its Translation Into English.

Communication Pursuant to Article 94(3) EPC Dated May 2, 2011 From the European Patent Office Re. Application No. 09758021.1.

Response Dated Nov. 2, 2011 to Communication Pursuant to Article 94(3) EPC of May 2, 2011 From the European Patent Office Re. Application No. 09758021.1.

* cited by examiner

FIG. 5
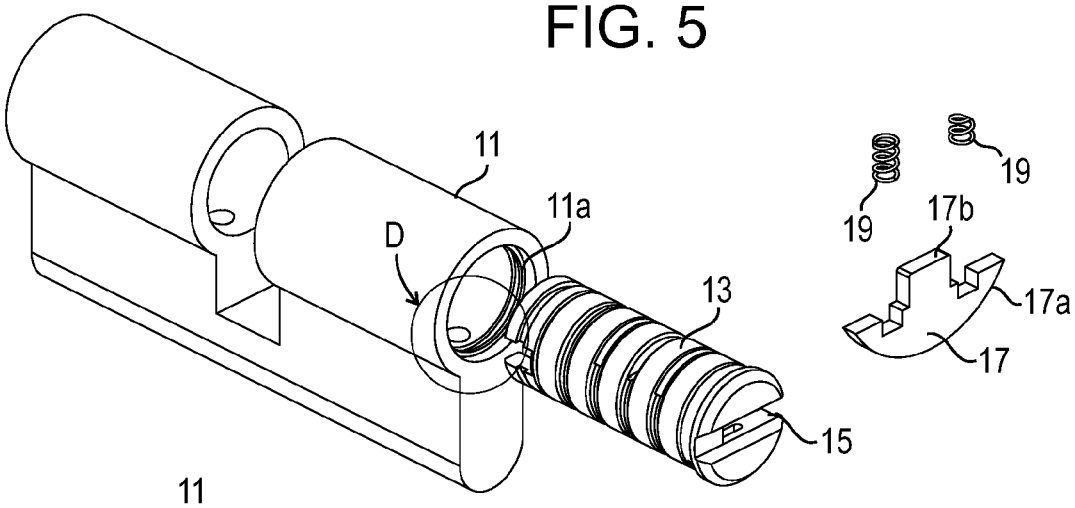
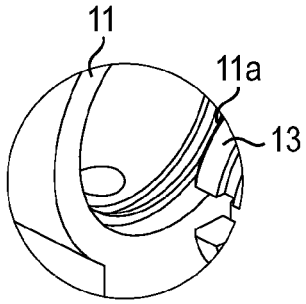
FIG. 5D
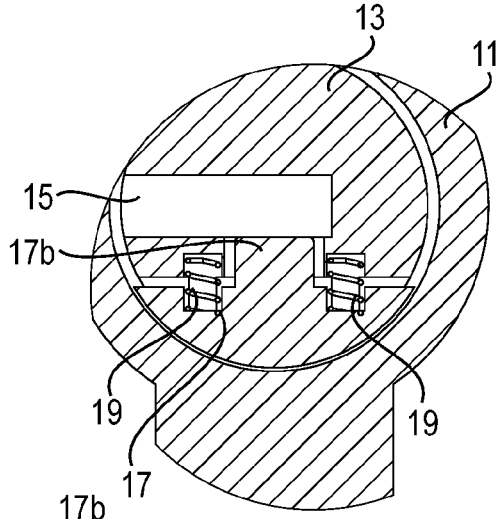
FIG. 5C
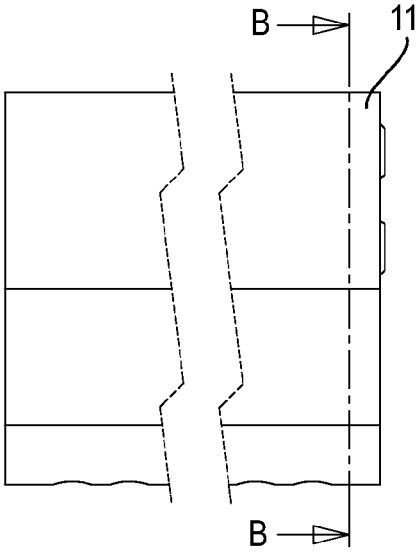
FIG. 5A
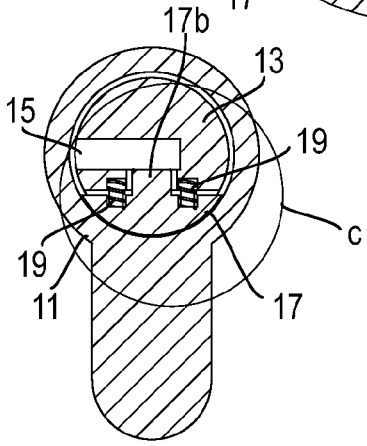
FIG. 5B FIG. 8
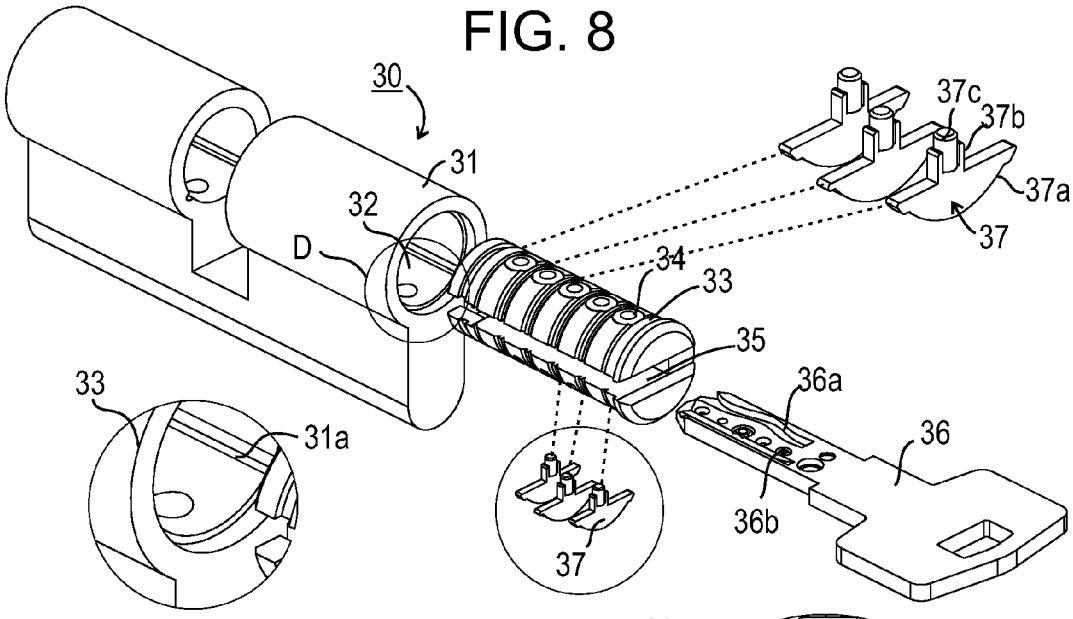
FIG. 8D
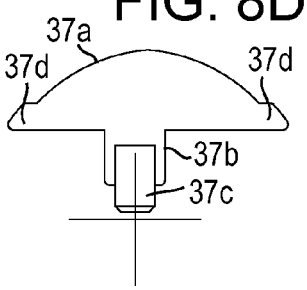
FIG. 8E
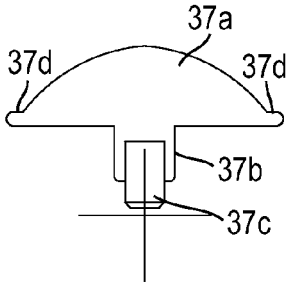
FIG. 8F
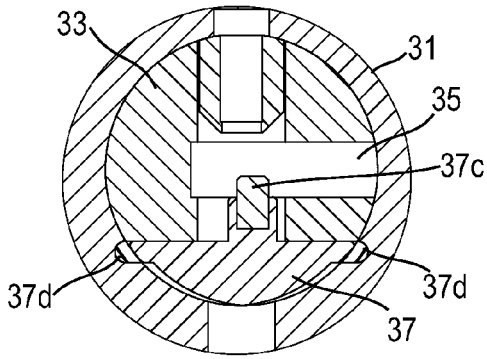
FIG. 8C
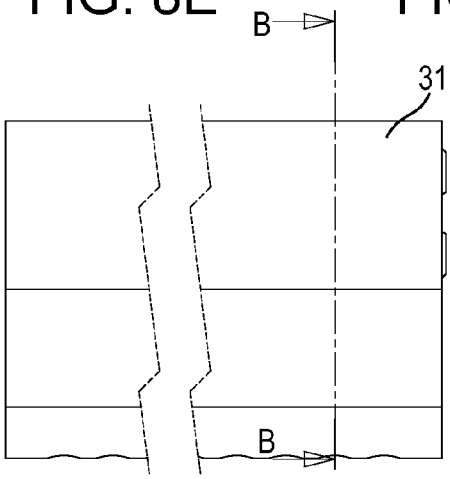
FIG. 8A
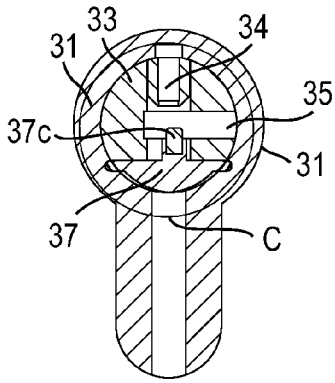
FIG. 8B

CYLINDER PROTECTIVE SYSTEM

RELATED APPLICATIONS

This Application is a National Phase of PCT Patent Application No. PCT/IL2009/000560 having International filing date of Jun. 4, 2009, which claims the benefit of Israel Patent Application Nos. 193553 filed on Aug. 19, 2008; 192858 filed on Jul. 16, 2008; and 192010 filed on Jun. 5, 2008. The contents of the above Applications are all incorporated herein by reference.

FIELD AND BACKGROUND OF THE INVENTION

The present invention relates to substantially burglary-proof cylindrical locks, particularly to locks providing a high degree of protection against any attempt to pull-out the cylinder from the housing and/or to drill through the cylinder in order to disable the lock.

The conventional cylindrical lock includes a housing formed with a cylindrical bore; and a cylinder within the bore carrying locking elements movable to locking and unlocking positions with respect to the housing. The cylinder has an outer diameter equal to the inner diameter of the housing defined by the bore, such that the cylinder can be rotated to its locking and unlocking positions with respect to the housing. The cylinder is formed with a keyway for receiving a proper key in order to move the locking elements of the cylinder, and to rotate the cylinder, to its locking and unlocking positions with respect to the housing.

The conventional cylindrical lock is very vulnerable to breakage. For example, a common way of breaking such a lock is to force a foreign object, such a screw, into the keyway in order to firmly grip the cylinder, and then to forcibly remove the cylinder from the housing. Another technique is to drill into the cylinder in order to weaken or separate the locking elements from the cylinder.

A number of techniques have been devised in order to make such cylindrical locks more burglary-proof, but the known techniques are generally so complicated, expensive, and/or insufficiently effective.

SUMMARY OF THE INVENTION

According to an aspect of some embodiments of the present invention there is provided a substantially burglary-proof cylindrical lock which is effective to prevent break-ins, and yet involves a relatively simple inexpensive construction which can be produced in volume and at low cost.

An aspect of some embodiments of the present invention provides for a substantially burglary-proof cylindrical lock, comprising: a housing formed with a cylindrical bore defining an inner cylindrical surface; and a cylinder within the bore carrying locking elements movable to locking and unlocking positions with respect to the housing; the cylinder having an outer diameter equal to the diameter of the bore so as to be rotatable when the locking elements are in unlocking position with respect to the housing; the cylinder being formed with a keyway for receiving a proper key in order to move the locking elements to their locking and unlocking positions with respect to the housing; characterized in that the cylinder carries at least one insert of a hard material configured, dimensioned and located such as to prevent pull-out of the cylinder from the housing by a pull-out force applied to the cylinder, and/or by drilling through the locking elements.

Optionally, the insert is configured, dimensioned and located with respect to the keyway of the cylinder such as: (a) to permit the normal entry of a proper key into the keyway, the movement of the locking elements to their locking and unlocking positions with respect to the housing, and the rotation of the cylinder with respect to the housing; (b) but upon the forceful entry of a foreign object into the keyway, to displace the insert radially outwardly to firmly engage the inner cylindrical surface of the housing, and thereby to increase the resistance of the cylinder to pull-out forces applied to the cylinder to pull it out of the housing.

Optionally, said insert of hard material is received within a groove formed in said cylinder such that a part of the insert communicates with said foreign object upon the forceful entry thereof into said keyway.

Optionally, said insert is in the form of a disc having an outer surface which normally does not protrude outwardly of the outer surface of the cylinder, and an inner stem which faces, and communicates with, said keyway such that the forceful entry of the foreign object into the keyway causes the foreign object to engage said inner stem of the insert and to force its outer surface to protrude outwardly of the outer surface of the cylinder and thereby to increase the resistance of the cylinder to said pull-out forces applied thereto.

Optionally, said insert is configured such that the forceful entry of the foreign object applies a radial force to the insert to cause the mid-portion of said outer surface to protrude outwardly of the outer surface of the cylinder.

Optionally, said insert is configured such that the forceful entry of the foreign object applies a radial force to the insert to cause an end-portion of said outer surface to protrude outwardly of the outer surface of the cylinder.

Optionally, said end portion of the outer surface of the insert is formed with a sharp edge so as to cut into the inner cylindrical surface of said housing.

The lock according to Claim 4, wherein the outer surface of said insert is rounded and has a radius of curvature equal to the radius of curvature of the inner cylindrical surface of the housing and concentric thereto, such that substantially the complete rounded outer surface of the insert is caused to protrude into engagement with the inner cylindrical surface of the housing.

Optionally, the outer surface of said insert is rounded and has a radius of curvature equal to or larger than the radius of curvature of the inner cylindrical surface of the housing and concentric thereto, such that the end portions of said rounded outer surface of the insert are caused to protrude into engagement with the inner cylindrical surface of the housing upon the forceful entry of said foreign object into the keyway.

The lock according to Claim 2, wherein said insert of hard material is of hard or tempered steel having a thickness of 0.5-1.2 mm.

Optionally, the inner cylindrical surface of said housing is formed with an annular groove, and said insert includes an outer rounded surface urged into said annular groove by a pair of springs at opposite sides of the insert to protect forceful pull-out of the cylinder from the housing.

Optionally, said hard material insert is located at the interface between the outer surface of the cylinder and the inner surface of the housing aligned with a locking element, so as to serve as an effective barrier against the penetration of a drill.

Optionally, said inner cylindrical surface of the housing is formed with an annular groove, and the outer surface of said cylinder is formed with an annular groove aligned with the annular groove of the housing; and wherein said hard material insert is an overlap ring seated in said annular grooves of the housing and cylinder to overlap the inner face between said cylinder and housing and thereby also to serve as an effective barrier against the penetration of a drill through said interface.

Optionally, said overlap ring is formed with a split at one side to enable the ring to be applied to said cylinder, and with an inwardly-extending stem in the opposite side seatable in an axially-extending groove formed in the outer surface of the cylinder for locating the overlap ring with respect to the cylinder.

Optionally, said cylinder includes a plurality of said overlap rings spaced along the length of said cylinder.

Optionally, said insert includes a stem receivable in a shaped slot formed in a proper key, such that the insert acts not only to prevent the introduction of an improper key in said keyway, but also to prevent rotation of the cylinder within the housing, by moving the insert laterally in the event of an attempt to introduce an improper key in said keyway.

Optionally, said insert includes a rounded outer surface formed with notches at its opposite ends, such that, upon the introduction of an improper key into the keyway, the insert is moved to cause said notches to protrude outwardly of the cylinder and into grooves formed in the inner cylindrical surface of the housing to prevent rotation of the cylinder within the housing.

Optionally, said insert includes a rounded outer surface formed with notches at its opposite ends, such that, upon the introduction of an improper key into the keyway, the insert is moved to cause said notches to protrude laterally of the cylinder and into grooves formed in the inner cylindrical surface of the housing to prevent rotation of the cylinder within the housing.

Optionally, said cylinder carries a plurality of said inserts of hard material spaced along the length of the cylinder.

Optionally, said plurality of inserts occupies different angular positions of said cylinder.

Optionally, said at least one insert of hard material is located between the entry end of said keyway and the first locking element carried by the cylinder, so as to serve as an effective barrier against the penetration of a drill.

Optionally, said cylinder is formed with at least one hole sized and shaped to receive said at least one insert of a hard material.

Optionally, said at least one hole extends between an outside surface of said cylinder and said keyway.

Optionally, said at least one hole comprises a plurality of holes positioned at oblique angles on the surface of said cylinder.

Optionally, said at least one hole is sized and shaped to form a tight friction fit with said at least one insert of a hard material.

Optionally, said at least one insert of a hard material is sector shaped.

Optionally, said sector shaped insert has an outer rounded surface and an inner radially-extending stem.

Optionally said at least one insert of a hard material is cylindrical shaped.

Optionally, said at least one insert of a hard material is pyramid shaped.

Optionally, said at least one insert of a hard material is cylindrical shaped with a head wider than a diameter of said cylinder.

Optionally, said head is hexagonal shaped.

Optionally, said at least one insert of a hard material comprises two parts.

Optionally, one of said two parts is a ball and the other of said two parts is a cylinder.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

FIG. 5 is an exploded view illustrating another burglary-proof cylindrical lock constructed in accordance with some embodiments of the present invention, wherein each of the hard metal inserts is spring-urged into a groove in the inner cylindrical surface of the housing; FIG. 5A is an enlarged side view of the lock; FIG. 5B is a sectional view along lines B-B of FIG. 5A; FIG. 5C is an enlarged fragmentary view of the encircled portion C of FIG. 5B; and FIG. 5D is an enlarged fragmentary view of the encircled portion D of FIG. 5;

FIG. 8 is an exploded view of a further cylindrical lock constructed in accordance with some embodiments of the present invention; FIGS. 8A-8D are views corresponding to those of FIGS. 5A-5D in FIG. 5, whereas FIGS. 8E and 8F illustrate two slightly different constructions of the hard disc insert which may be used in the lock of FIG. 8;

DESCRIPTION OF SPECIFIC EMBODIMENTS OF THE INVENTION

Figure 1:
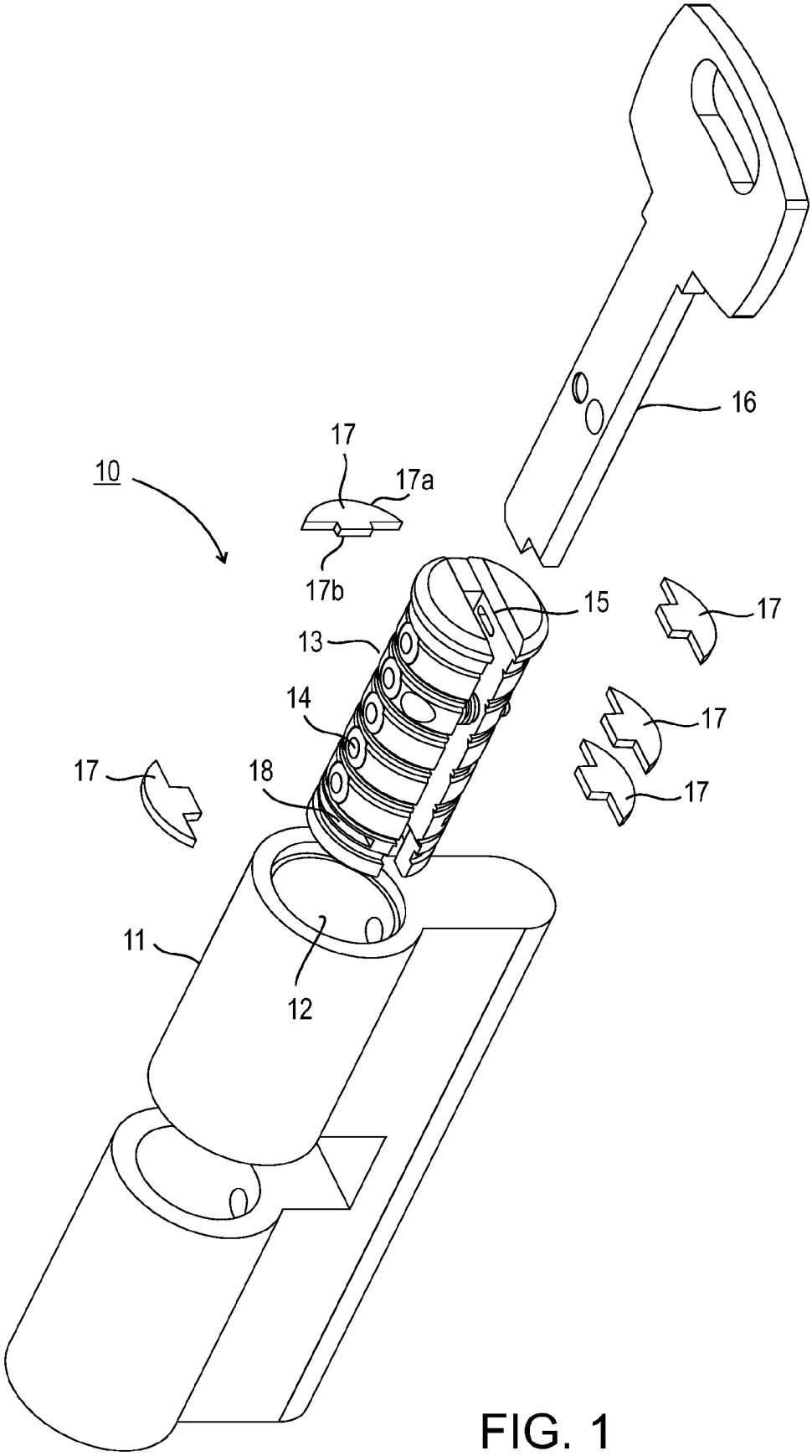
FIG. 1 is an exploded view illustrating form of substantially burglary-proof cylindrical lock constructed in accordance with some embodiments of the present invention.

The present invention relates to substantially burglary-proof cylindrical locks, particularly to locks providing a high degree of protection against any attempt to pull-out the cylinder from the housing and/or to drill through the cylinder in order to disable the lock.

In some preferred embodiments of the invention described below, the insert is configured, dimensioned and located with respect to the keyway of the cylinder such as: (a) to permit the normal entry of a proper key into the keyway, the movement of the locking elements to their locking and unlocking positions with respect to the housing, and the rotation of the cylinder with respect to the housing; (b) but upon the forceful entry of a foreign object into the keyway, to displace the insert radially outwardly to firmly engage the inner cylindrical surface of the housing, and thereby to increase the resistance of the cylinder to pull-out forces applied to the cylinder to pull it out of the housing.

As will be described more particularly below, this displacement of the hard material insert, by the forceful entry of the foreign object (e.g., a screw or drill) into the keyway, causes the hard insert to move laterally to firmly engage the inner cylindrical surface of the housing such as to increase the frictional forces, and/or to gouge into the inner surface of the housing, thereby to very substantially increase the pull-out force required to forcibly remove the cylinder.

According to further features in some described preferred embodiments, the insert of hard material is received within a groove formed in the cylinder such that a part of the insert communicates with the foreign object upon the forceful entry thereof into the keyway. In these embodiments, the insert is in the form of a disc and has an outer surface which normally does not protrude outwardly of the outer facing surface of the cylinder, and an inner facing surface, e.g. a stem which faces and communicates with the keyway such that the forceful entry of the foreign object into the keyway causes the foreign object to engage the inner facing surface of the insert and to force its outer facing surface to protrude outwardly of the outer facing surface of the cylinder and thereby to increase the resistance of the cylinder to pull-out forces.

According to a further feature which may be used in any of the described embodiments, the inner cylindrical surface of the housing is formed with an annular groove, and the insert includes an outer rounded facing surface urged into the annular groove by a pair of springs at opposite sides of the insert to prevent forceful pull-out of the cylinder from the housing.

Preferably, the insert is of hard steel having a thickness of 0.5-1.2 mm. It may be located so as to serve as an effective barrier against the penetration of a drill Using such a relatively thin insert not only enhances the pull-out strength of the lock, but also better protects the lock against drilling since the thin hard insert tends to jam the drill bit.

According to a still further described embodiment, the inner cylindrical surface of the housing is formed with an annular groove, and the outer surface of the cylinder is formed with an annular groove aligned with the annular groove of the housing; and wherein the hard material insert is an overlap ring seated in the annular grooves of the housing and cylinder to overlap the inner face between the cylinder and housing and thereby to serve as an effective barrier against both pull out forces and the penetration of a drill through the interface.

According to a still further described embodiment, the insert includes a stem receivable in a shaped slot formed in a proper key, such that the insert acts not only to prevent the introduction of an improper key in the keyway, but also to prevent rotation of the cylinder within the housing, by moving the insert laterally in the event of an attempt to introduce an improper key in the keyway.

In most applications of the present invention, the cylinder carries a plurality of the inserts of hard material spaced along the length of the cylinder. The plurality of inserts occupies different angular positions of the cylinder. At least one of the pluralities of inserts of hard material is preferably located between the entry end of the keyway and the first locking element carried by the cylinder so as to serve as an effective barrier against the penetration of a drill.

Further features and advantages of the invention will be apparent from the description below.

The Embodiments of FIGS. 1-5

FIGS. 1-5 illustrate various embodiments of a cylindrical lock of a conventional construction but modified so as to render it substantially burglary-proof in accordance with the present invention.

Figure 2:
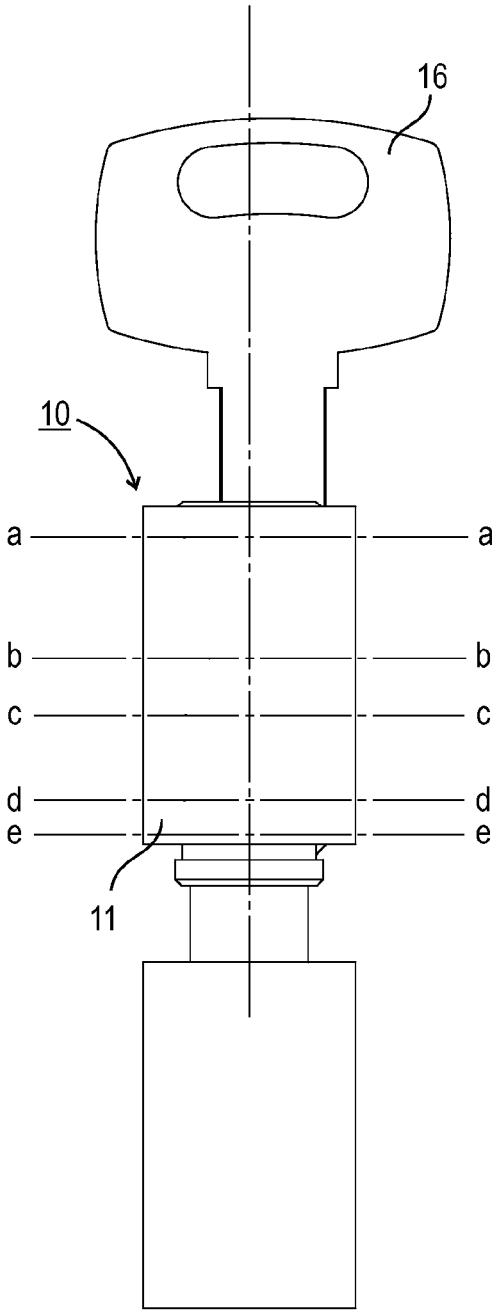
FIG. 2 is a top plan view of the lock of FIG. 1 in assembled condition, FIGS. 2A-2E being sections along lines a-e of FIG. 2.
Figure 2B:
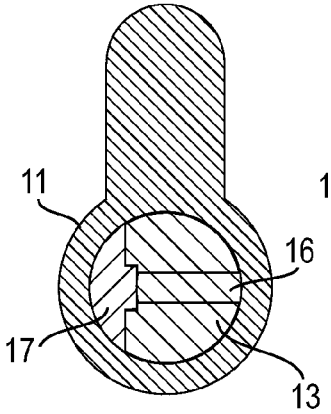
Figure 2A:
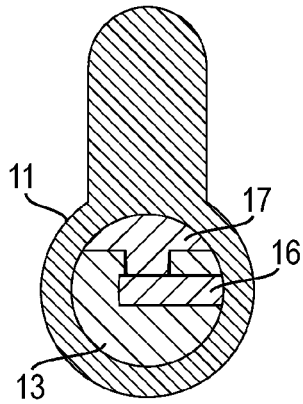
Figure 2C:
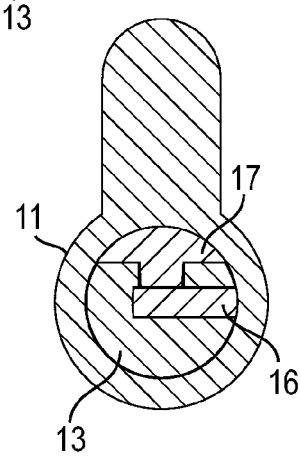
Figure 2D:
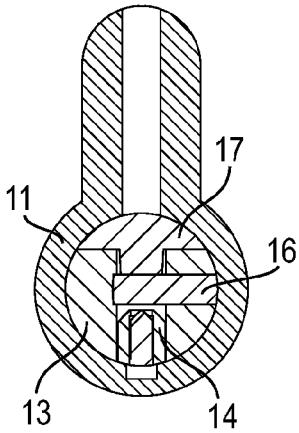
Figure 2E:
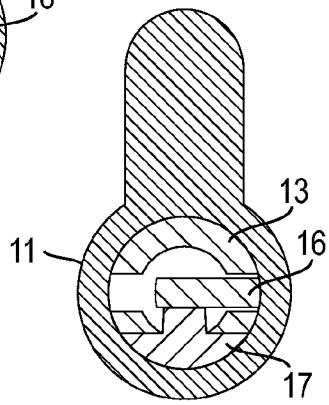

One embodiment is shown in the exploded view of FIG. 1, and the assembled view of FIG. 2, wherein the cylindrical lock, therein generally designated 10, includes a housing 11 formed with a cylindrical bore 12 defining an inner cylindrical surface of the housing. The lock further includes a cylinder 13 within bore 12 and carrying a plurality of locking elements, such as pins 14, movable to locking and unlocking positions with respect to the housing. Cylinder 13 has an outer diameter equal to the diameter of the bore 12 in housing 11 so as to enable rotation of the cylinder with respect to the housing. Cylinder 13 is formed with a keyway 15 for receiving a proper key 16 in order to move the locking elements 14, and to rotate the cylinder with respect to the housing.

Since such locks are well known, further details of the construction or the operation of the lock are not set forth herein.

According to the present invention, cylinder 13 is provided with at least one insert of a hard material, which insert is configured, dimensioned and located with respect to keyway 15 such as to prevent pull-out of the cylinder from the housing by a pull-out force applied to the cylinder, and/or by drilling through the locking elements. In the embodiment of FIGS. 1-5, there are plurality of such inserts, each configured, dimensioned and located, (a) to permit the normal entry of a proper key into the keyway, the movement of the locking elements to their locking and unlocking positions with respect to the housing, and the rotation of the cylinder with respect to the housing; (b) but upon the forceful entry of a foreign object into the keyway, to displace the insert radially outwardly to firmly engage the inner cylindrical surface of the housing and thereby to increase the resistance of the cylinder to pull-out forces applied to the cylinder to pull it out of the housing.

As illustrated in FIGS. 1 and 2, the lock includes a plurality of the hard material inserts 17 spaced along the length of cylinder 13 and occupying different angular positions of the cylinder. For this purpose, cylinder 13 is formed with a plurality of grooves 18 spaced along the length of the cylinder, and in different angular positions thereof, each for receiving one of the inserts 17.

Each insert 17 is a thin, sector-shaped disc having an outer facing rounded surface 17*a*, and an inner radially-extending stem 17*b*. Each hard insert 17 is dimensioned and located such that during the normal operation of the lock, the outer rounded facing surface 17*a* of the insert does not protrude outwardly of the outer surface of cylinder 13, but rather is either flush therewith or somewhat recessed with respect thereto. In addition, the inner stem 17*b* of each hard insert 17 faces, and communicates with, the keyway 15, as shown particularly in the sectional views of FIGS. 2*a*-2*e*.

Accordingly, during normal conditions, a proper key 16 may be inserted into keyway 15, as shown in FIGS. 2*a*-2*e*, and may be rotated within the cylinder first to move elements 14 to their locking or unlocking positions, and then to rotate the cylinder. After the pins have been moved and the cylinder rotated, the key may be withdrawn from the keyway 15.

On the other hand, if, instead of a proper key, a foreign object, such as a screw or a drill, is forcibly entered into keyway 15, the foreign object will engage stem 17*b* of one or more hard inserts 17 to thereby apply a radial force to the respective insert in the direction to force its outer facing surface 17*a* to protrude outwardly of the outer surface of cylinder 13. As a result, the resistance of the cylinder to pull-out forces is substantially increased, by the high friction applied by the insert to the inner surface of the housing, or by the outer facing surface of the insert actually gouging into the inner surface of the housing. Accordingly, the addition of the inserts in the illustrated lock prevents removal or disablement of the lock by forcing a foreign object, such as a screw into the keyway 15 to firmly grip the cylinder in order to pull it out from the housing.

Optionally, the groove 18 in cylinder 13 through which insert 17 is inserted does not penetrate through keyway so that a layer of material from cylinder 13 is left (or optionally positioned) between insert 17 and keyway 15. Optionally the layer of material provides for retaining the inserts within in the grooves and allowing for a smooth obstructed path for inserting a key. Typically, the layer of material is thin enough so that in response to a foreign object, such as a screw or a drill, forcibly entered into keyway 15, the layer of material will be deformed and the foreign object will engage, e.g. indirectly engage, insert 17 via the layer of material positioned between keyway 15 and insert 17. A radial force applied on insert 17 in the direction to force its outer facing surface 17*a* to protrude outwardly of the outer surface of cylinder 13.

It will be appreciated that this construction not only substantially increases the resistance of the cylinder to pull-out forces, but also increases the shear and bending strength of the cylinder against attempts to break the cylinder. It will also be appreciated that the increase in resistance of the cylinder to such pull-out forces will be related to the size of the foreign object, and thereby the gripping power of the foreign object with respect to the cylinder. That is, the larger the foreign object (e.g., screw) used in an attempt to pull-out the cylinder from the housing, the larger will be the resistance of the cylinder exerted by the hard inserts 17 to such pull-out forces.

The hard inserts 17 illustrated in the lock of FIGS. 1 and 2 are preferably of hard steel or tempered steel of a thickness of 0.5-1.2 mm. Such a construction for the hard inserts increases the resistance of the cylinder to pull-out forces as described above, but also serves as an effective barrier against the penetration of a drill particularly since an insert of a thickness in the above range tends to jam the drill bit if an attempt is used to drill through it.

Figure 4A:
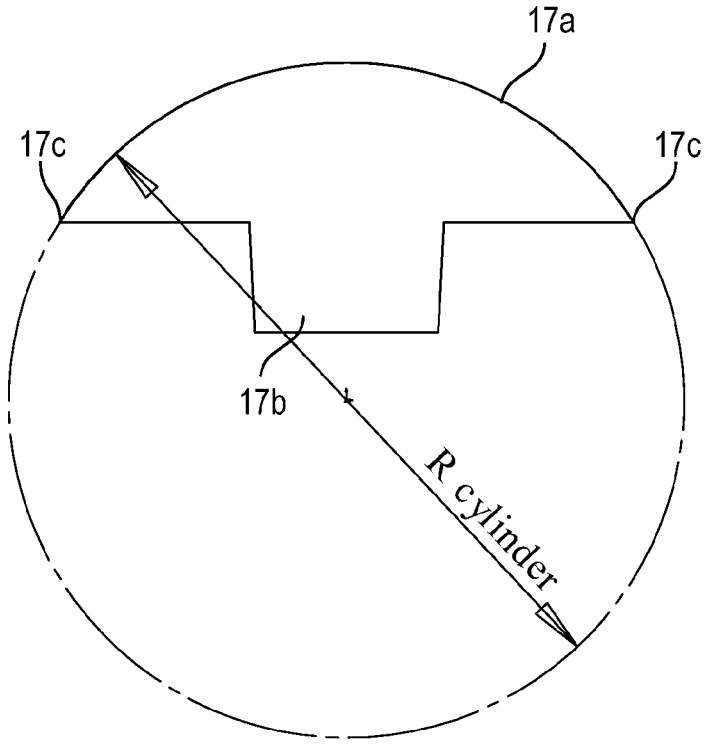
FIGS. 4A-4D are enlarged views illustrating three slightly different constructions of the hard metal inserts in accordance with some embodiments of the present invention.

It will be appreciated that when the outer facing surface 17*a* is rounded with a radius of curvature the same as that of the outer surface of the cylinder 13 and concentric thereto, as shown in FIG. 4*a*, substantially the complete outer rounded facing surface 17*a* is caused to protrude firmly against, or into, the inner cylindrical surface of the housing defined by bore 12, and thereby to increase the resistance of the cylinder to pull-out forces. It will also be appreciated that the outer facing surface 17*a* of each insert may not only be continuously rounded, as shown, but may also be somewhat recessed in the center region, or may be formed with grooves or teeth in the center region, in order to more firmly engage or bite into the inner cylindrical surface of the housing.

Figure 3A:
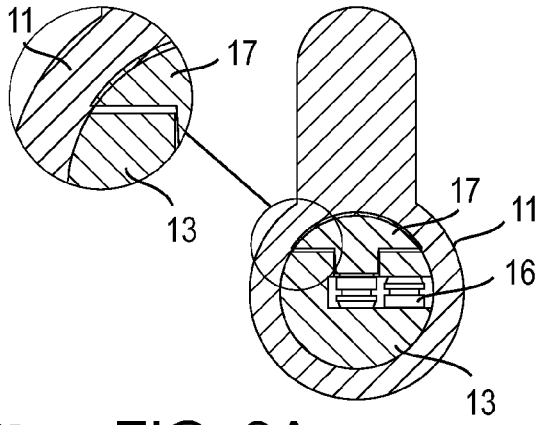
FIGS. 3A-3E are views corresponding to those of FIGS. 2A-2E but slightly modified such that the forceful entry of a foreign object into the keyway moves each hardened metal insert not only radially, but also slightly laterally, to further enhance the pull-out resistance of the cylinder from the housing.
Figure 3B:
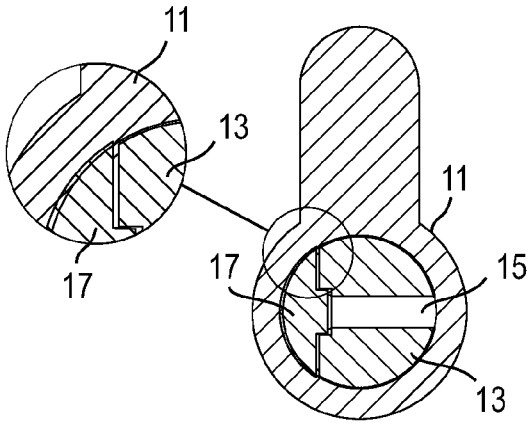
Figure 3C:
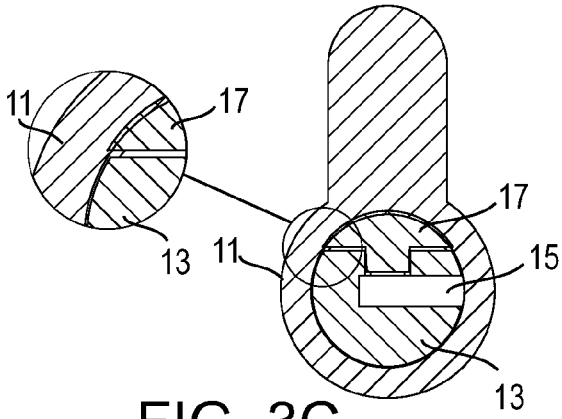
Figure 3D:
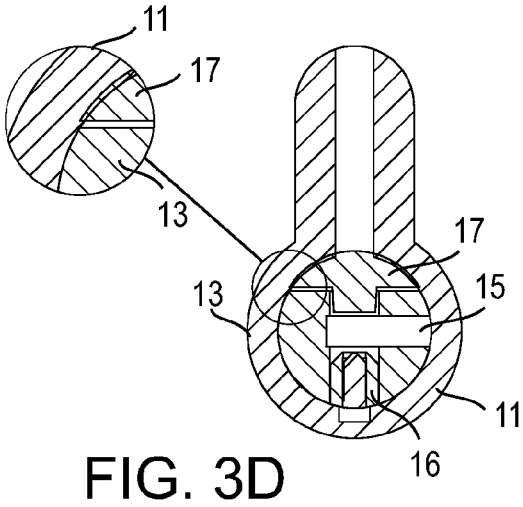
Figure 3E:
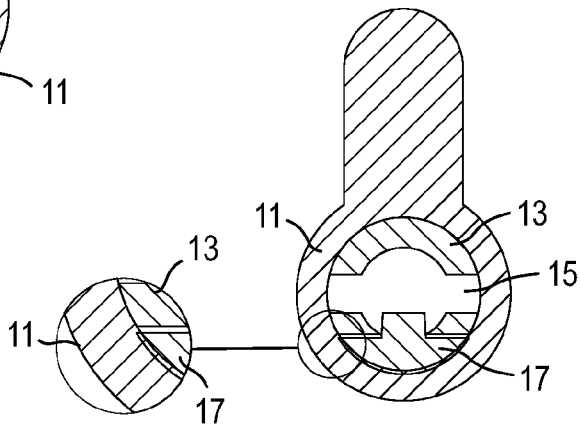
Figure 4B:
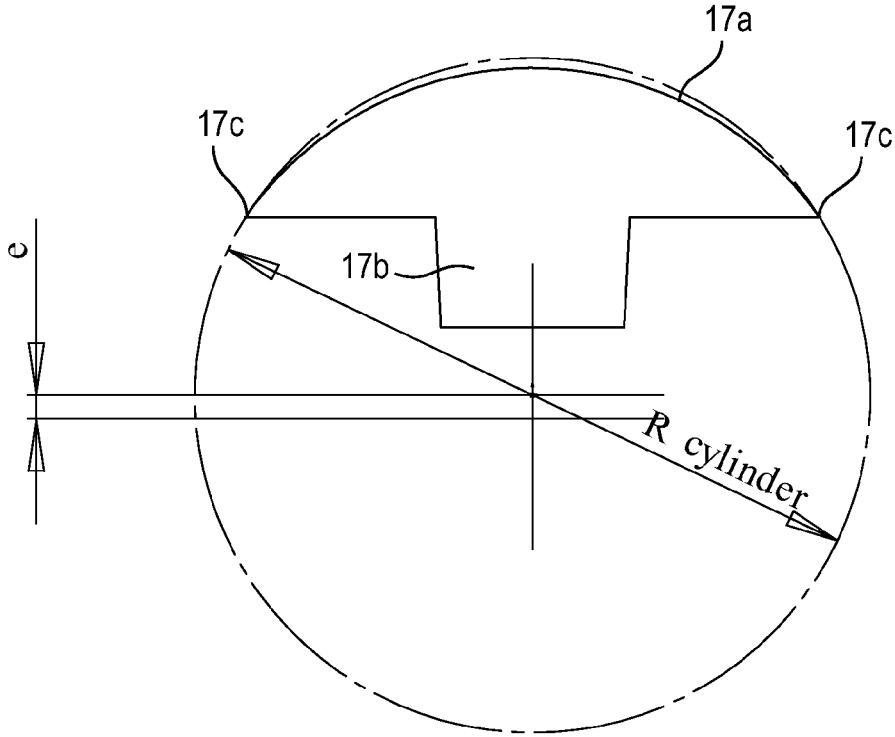

FIGS. 3*a*-3*b* of the drawings illustrate a slight modification which may be used, wherein each insert 17 has a rounded outer facing surface having a radius of curvature equal to or larger than that of the outer surface of cylinder 13 and eccentric thereto, as shown in FIG. 4*b*. In such case, when the foreign object is forcefully applied into keyway 15, the insert tends to move radially outwardly such that one or both end portions, e.g., 17*c*, of the outer rounded facing surface 17*a* project further outwardly of the cylinder surface to more firmly engage, or to gouge into, the inner cylindrical surface of the housing, thereby further increasing the resistance of the cylinder to pull-out forces.

FIG. 4*a* is an enlarged view more particularly illustrating each of the hard inserts 17, wherein the outer rounded facing surface 17*a* of the insert has the same radius of curvature as, and concentric to, the outer surface of cylinder 13. FIG. 4*b* illustrates an insert, wherein its outer rounded facing surface 17*a* has an equal or a larger radius of curvature than the outer surface of cylinder 13, and eccentric thereto, such that the end portions 17*c* of the outer rounded facing surface 17*a* of the insert will be moved into engagement with the inner cylindrical surface of the housing to increase the resistance of the cylinder to pull-out forces.

Figure 4C:
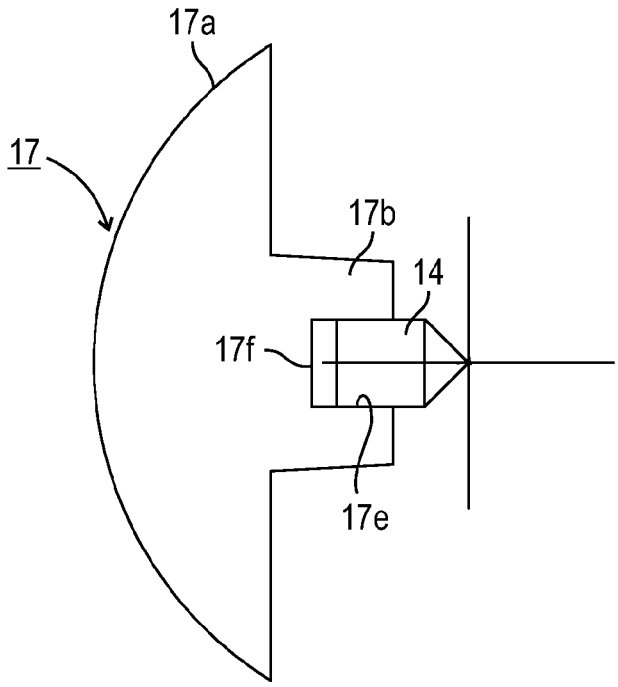

The insert 17 illustrated in FIG. 4*c* is of a similar construction as in FIG. 4*a* or 4*b*, but the stem 17*b* is formed with an opening 17*e* for accommodating a pin 14 of the locking mechanism. Pin 14 may be of different cross-sections, and not necessarily rounded. Pin 14 does not occupy the complete length of opening 17*e*, so as to define a space 17*f*. The arrangement is such that, when the proper key is inserted into the keyway 15, the locking pin 14 is accommodated by space 17*f*, and thereafter the insert is not displaced into a protruding relationship with respect to the outer surface of the cylinder, thereby permitting the lock to be operated in the normal manner. However, when an improper key is introduced into the keyway, pin 14 is not accommodated by space 17*f*, and therefore the pin is blocked from moving to its unlocking position by the key.

Figure 4D:
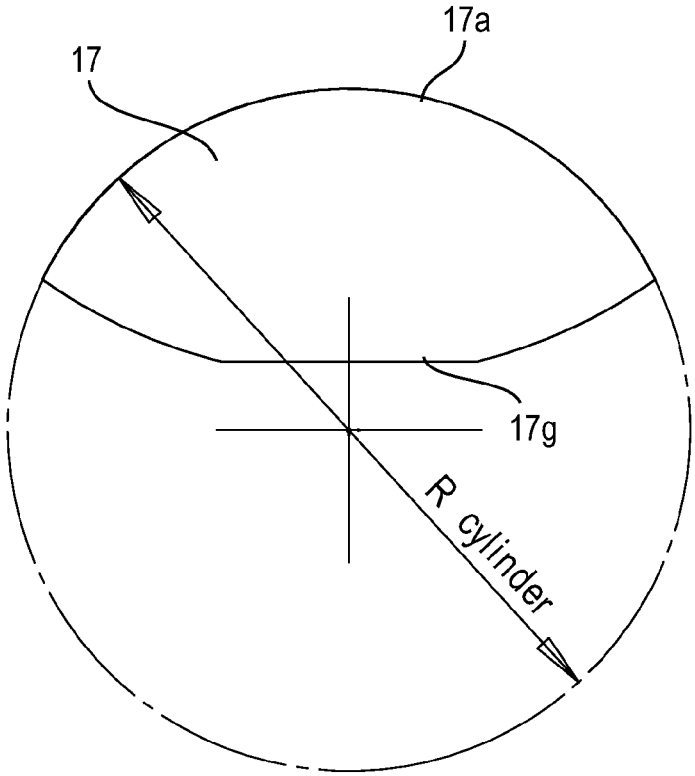

The insert 17 illustrated in FIG. 4*d* may function in a similar manner as insert 17 shown in FIG. 4*a* and/or FIG. 4*b* but does not include a stem. In such an embodiment, an inner surface 17*g* is operable to communicate with the keyway 15. Optionally, an opening may be formed on inner surface 17*g* for accommodating a pin as described in reference to FIG. 4*c*.

FIG. 5 and its various views shown in FIGS. 5*a*-5*d*, illustrate another modification which may be included in the lock. In this modification, only one hard insert 17 is provided, and this at the entry end of keyway 15. In this case, the inner cylindrical surface of housing 11 is formed with an annular groove 11*a*, and a pair of springs 19 is provided on opposite sides of stem 17*b* of the insert for urging the outer rounded facing surface 17*a* of the insert into groove 11*a*. Such a construction is particularly effective to prevent the penetration of a drill into the cylinder. It also increases the resistance of the cylinder to pull-out forces upon the forceful entry of a foreign object, as described above.

It will be appreciated that in all of the above-described embodiments, the hard inserts can be applied not only perpendicularly to the longitudinal axis of the keyway as illustrated, but also at an oblique angle with respect to the longitudinal axis. Such an oblique angle will be effective to even more greatly enhance the resistance of the cylinder to pull-out forces.

Figure 6A:
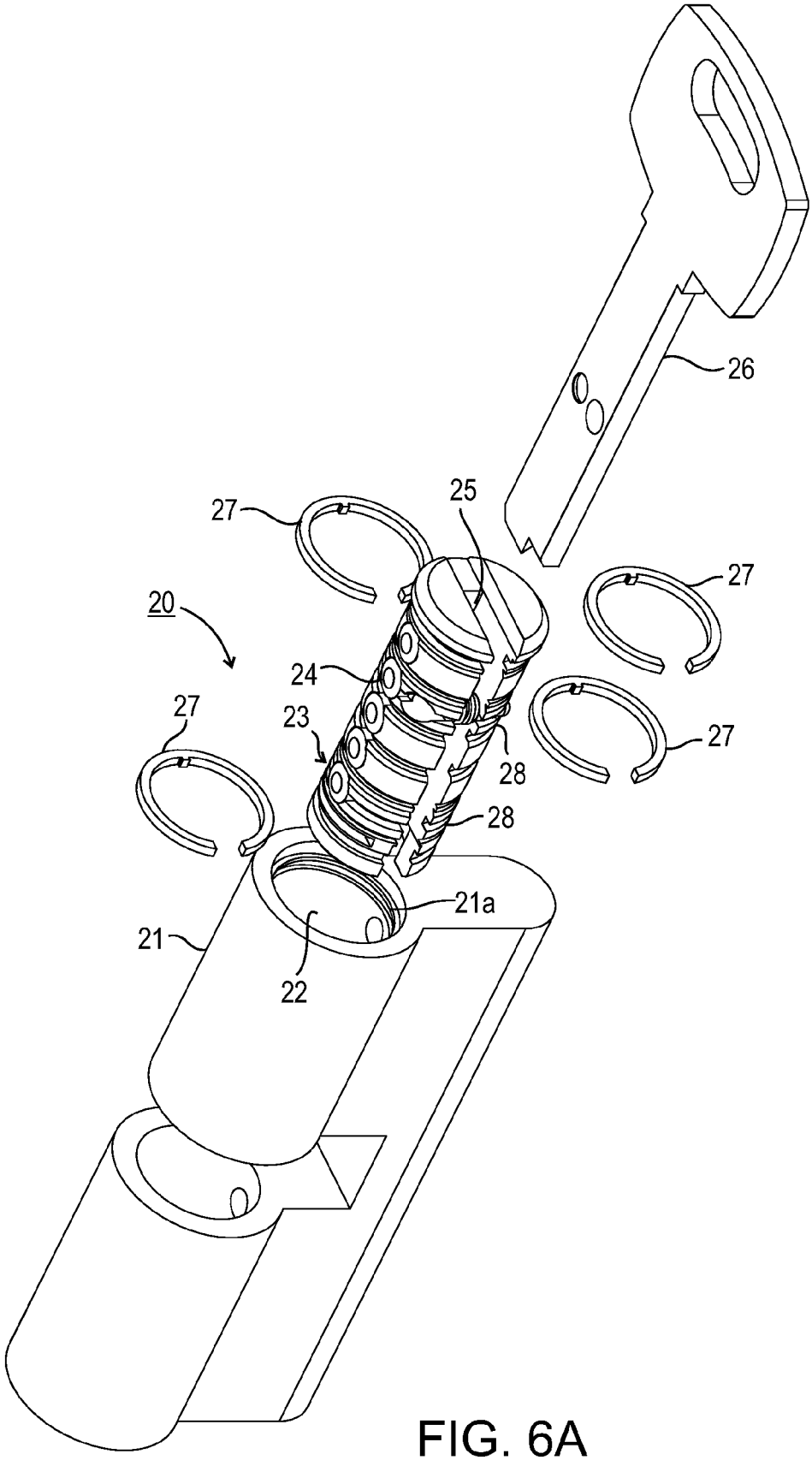
FIG. 6A is an exploded view illustrating another substantially burglary-proof lock constructed in accordance with the some embodiments of the present invention including overlap rings carried by the cylinder and adapted to be seated in annular grooves formed in the inner surface of the housing, in order to increase the pull-out resistance of the cylinder from the housing.
Figure 6B:
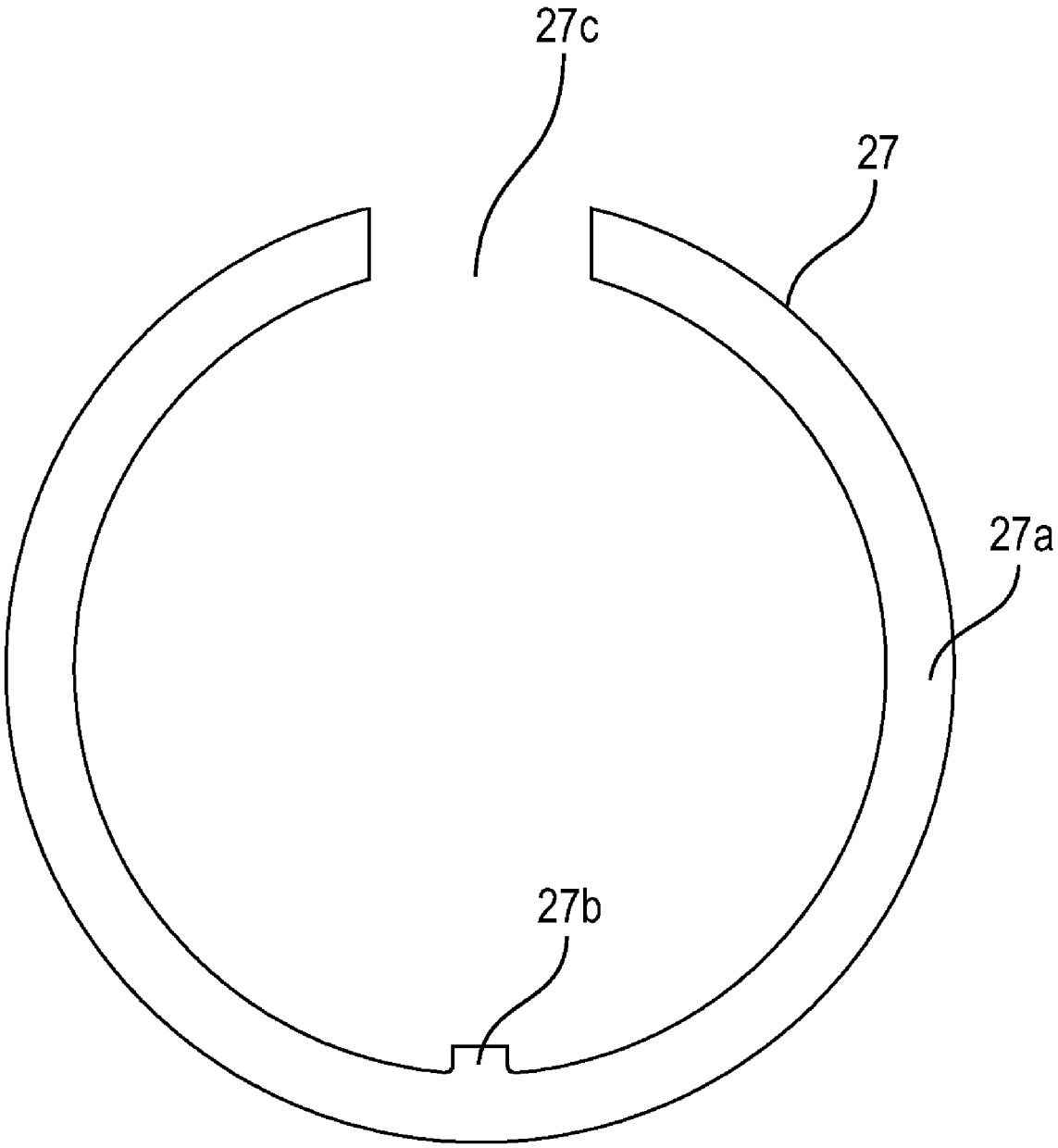
FIG. 6B illustrates an overlap ring.
Figure 7:
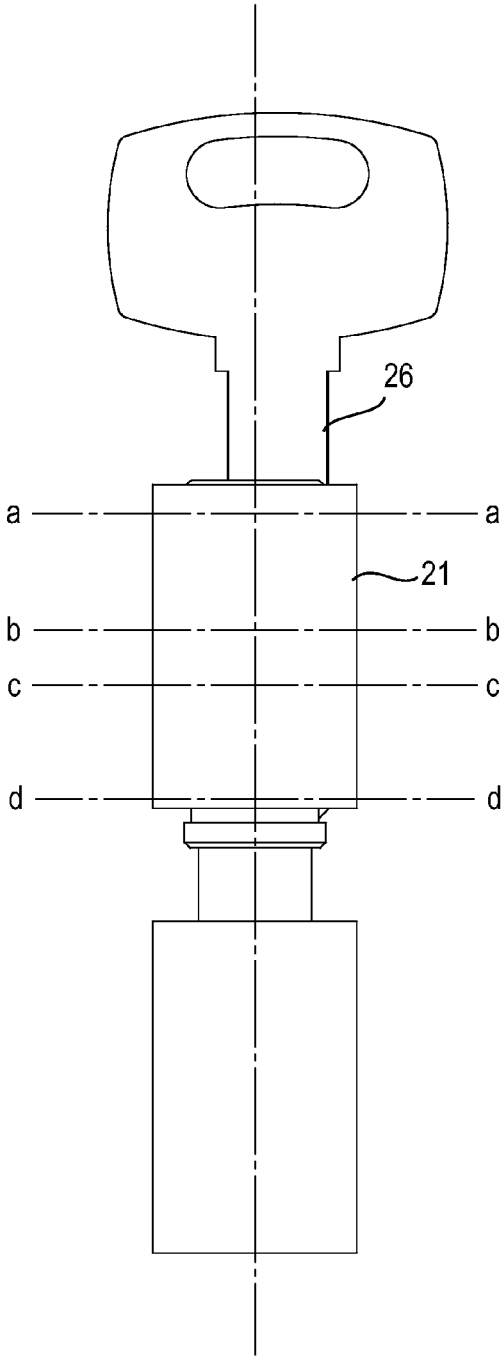
FIG. 7 illustrates the cylindrical lock of FIG. 6 in assembled condition, FIGS. 7A-7D being sectional views along lines a-d of FIG. 7.
Figure 7A:
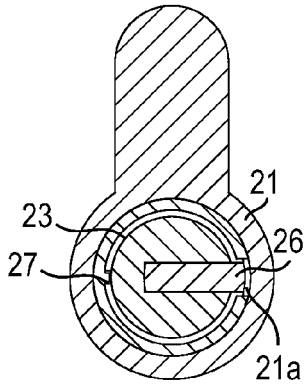
Figure 7B:
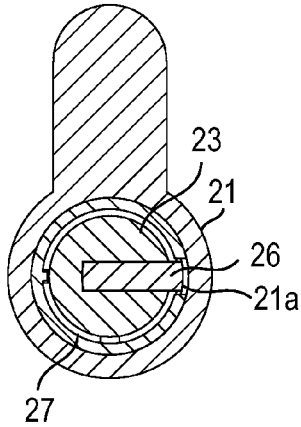
Figure 7C:
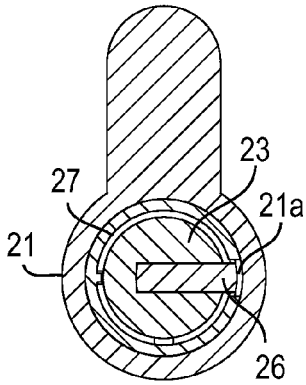
Figure 7D:
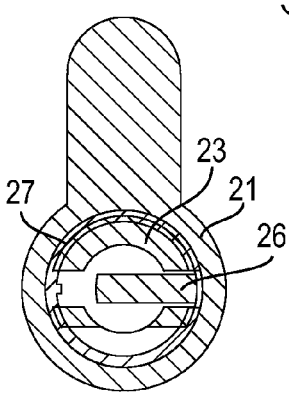

The Embodiment of FIGS. 6 and 7

FIGS. 6 and 7 illustrate a further embodiment of the invention which may also be used in a conventional cylindrical lock for providing protection against burglary. Thus, the cylindrical lock illustrated in FIGS. 6 and 7, therein generally designated 20, also includes a housing 21 formed with a cylindrical bore 22 defining an inner cylindrical surface, and a cylinder 23 within the bore carrying locking elements 24 movable to locking and unlocking positions with respect to the housing. As described above, cylinder 23 has an outer diameter equal to the diameter of the bore 22 so as to be rotatable with respect to the housing upon the insertion of a proper key 26 into the keyway 25 formed in cylinder 23.

In this embodiment, however, the inserts of hard material are configured, dimensioned and located with respect to the cylinder to prevent burglary not only by increasing the resistance of the cylinder to pull-out forces, but also by preventing drilling through the shear line, that is the interface between the outer surface of the cylinder and the inner surface of the housing to break the locking elements 24. Thus, instead of using a hard insert of a sector-shaped disc construction as in FIGS. 1-5, the embodiment of FIGS. 6 and 7 uses hard inserts in the form of overlap rings 27 received within grooves 28 formed in the outer surface of cylinder 23 spaced along its length and seatable in annular grooves 21*a* formed in inner cylindrical surface of housing 21 defined by bore 22.

The construction of each overlap ring 27 is more particularly illustrated in FIG. 6*b*, wherein it will be seen that it includes a substantially outer circular portion 27*a* and an inwardly-extending stem 27*b*. The circular ring portion 27*a* is interrupted or split, as shown at 27*c*, at one side diametrically opposite to the side of its stem 27*b* so as to facilitate application of the overlap ring to the cylinder. An axial groove 23*a* is formed in the outer surface of the cylinder aligned with the split 27*c*.

The overlap rings 27 also made of a hard material such as hard or tempered steel, are effective to prevent both pull-out of the cylinder and penetration of a drill through the shear line, or interface, between the outer surface of the cylinder and the inner surface of the housing in an attempt to break the lock by shearing away the locking elements.

The Embodiment of FIG. 8

FIG. 8 illustrates a further embodiment of the invention, similar to that of FIGS. 1 and 2, but modified to permit the hard inserts to be used not only for increasing the pull-out strength of the cylinder from the house, but also for enhancing the locking and unlocking mechanism.

Thus, the lock illustrated in FIG. 8, and therein designated 30, also includes a housing 31 formed with a cylindrical bore 32 for receiving a cylinder 33 having a plurality of locking elements 34 and a keyway 35 for receiving a key 36 in order to lock and unlock the lock. Cylinder 33 also includes a plurality of inserts 37 spaced along the length of the cylinder at different angular positions with respect thereto, with each insert having a round outer facing surface 37*a* and an inwardly-extending stem 37*b*. In this case, however, each insert 37 further includes a pin 37*c* received within stem 37*b* and projecting inwardly thereof. In addition, an annular notch 37*d* is formed in the outer rounded facing surface 37*a*. These notches interface with longitudinal grooves 31*a* formed in the inner cylindrical surface of housing 31.

The lock illustrated in FIG. 8 is adapted for use with a key 36 of a construction including an elongated, shaped slot 36*a*, which is normally used with conventional projections or depressions 36*b*, for engaging the locking elements 34 in order to move them to a locking or unlocking position by the insertion of the key. The pins 37*c*, of each of the hard inserts 37, are designed to interface with slots 36*a* of key 36 to thereby enable the inserts also to be used as part of the locking mechanism upon the insertion of a proper key. Thus, if the key is not a proper one, the notch 37*d* will not disengage out of the longitudinal slot 31*a* within the housing which will thereby prevent the key from properly moving the locking elements to their unlocking position.

Moreover, should a foreign object be forcibly entered into the keyway, the foreign object will engage pins 37*c* of the inserts 37 to cause its outer facing surfaces 37*a* to protrude outwardly of the outer surface of the cylinder 33, and the notches 37*d* to be received in groove 31*a*, due to a lateral movement, and thereby to substantially increase the resistance of the cylinder with respect to pull-out forces.

While the invention has been described with respect to several preferred embodiments, it will be appreciated that these are set forth merely for purposes of example, and that many variations may be made. For example, a burglary-proof cylindrical lock may be constructed including both the sector-shaped hard inserts of FIGS. 1-5 and 8, as well as the overlap loops or rings of FIGS. 6 and 7. In addition, whereas the sector-shaped hard inserts are shown as located substantially perpendicularly to the longitudinal axis of the cylinder, they can also be located somewhat obliquely to the longitudinal axis. The edge or edges of the hard inserts caused to protrude outwardly of the outer surface of the cylinder may be formed with cutting edges, to actually gouge into the inner surface of the cylinder defined by the bore, and thereby to further enhance the resistance of the cylinder to pull-out forces. Preferably, the sector-shaped hard inserts have a modulus of elasticity higher than that of the cylindrical housing modulus of elasticity. Further, while the sector-shaped hard metal inserts are shown as occupying sectors of approximately 180°, the sector portion of the insert could be smaller or larger, according to any desired application. Further, the inserts do not need to be sector-shaped, but can be any size or shape that fulfills the function of not interfering with normal operation of the lock, while firmly engaging the inner cylindrical surface of the housing and thereby increasing the resistance of the cylinder to pull-out forces upon forceful entry of a foreign object into the keyway.

Figure 9:
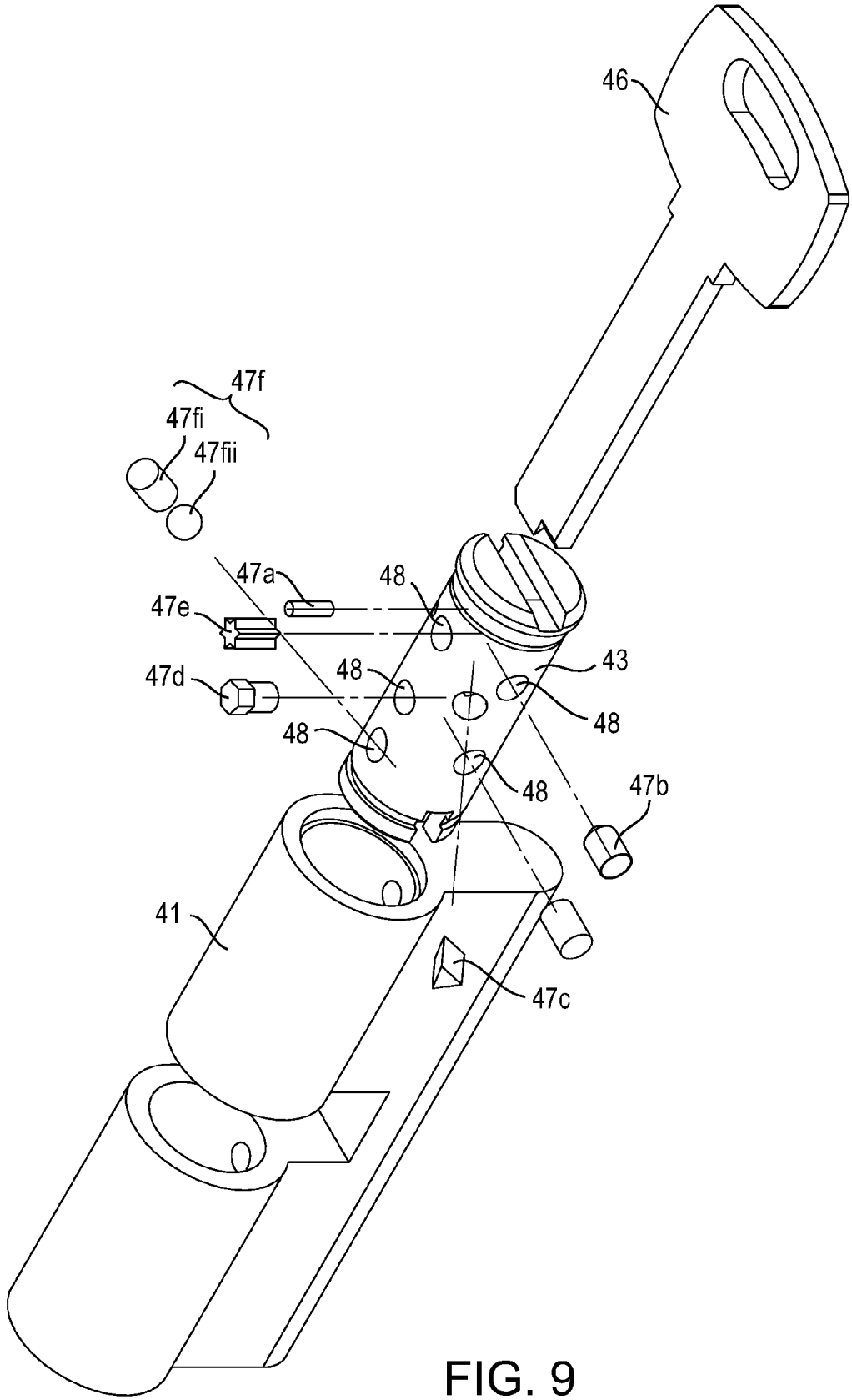
FIG. 9 is a perspective view of a cylindrical lock having a variety of inserts in accordance with some embodiments of the present invention.

Examples of different types of inserts 47 are shown in FIG. 9. The figure shows a key 46 and a housing 41 having an inner bore into which fits cylinder 43. The figure shows a number of different inserts 47, each of which fits into a corresponding hole 48 in cylinder 43. As indicated, insert 47*a* is a narrow cylinder, insert 47*b* is a relatively wider cylinder, and insert 47*c* is pyramid shaped. Insert 47*d* is a cylinder with a wide hexagonal head, and insert 47*e* has a star-shaped cross-section. Insert 47*f* has two parts, a cylinder 47*fi* and a ball 47*fii*. The two parts stand on top of one another in hole 48, generally with ball 47*fii* positioned closer to the keyway of cylinder 43. Optionally, the hole 48 is tapered and the ball at least partially retained in the tapered portion of hole 48 provides physical communication between cylinder 47*fi* and a potential foreign object inserted into the keyway without obstructing entry of a matching key into the keyway.

As shown in FIG. 9 the holes can be oriented at any angle in cylinder 43. In the figure some holes are arranged in a row along a top of cylinder 43, while others are located at various oblique angles, in different positions on the surface of cylinder 43.

Figure 10A:
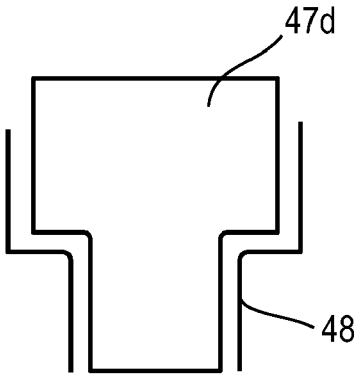
FIGS. 10A, 10B, and 10C show cross-section views of some of the holes of FIG. 9, with inserts inserted in accordance with some embodiments of the present invention.
Figure 10B:
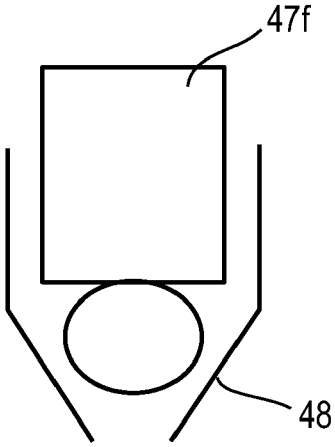
Figure 10C:
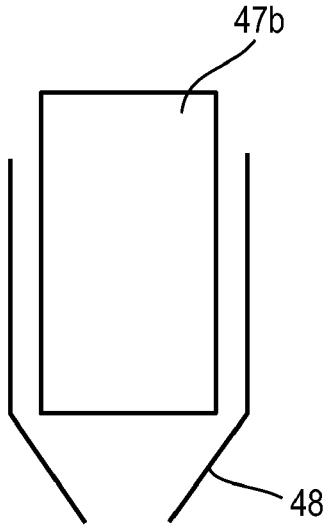

FIGS. 10A-10C show samples of cross-sections of holes sized and shaped to fit the various inserts 47. FIG. 10A shows hole 48 sized and shaped to receive insert 47*d* and prevent it falling into the keyway, and FIGS. 10B and 10C show holes 48 having a taper to fit and retain inserts 47*f* and 47*b* respectively. For purposes of illustration the holes are shown as wider than the inserts, but the holes can be sized and shaped to form a close press-fit with their respective inserts. Optionally, the inserts are friction fitted so that the inserts are pressed into their respective holes with a high degree of friction. Optionally, when the inserts are friction fitting, a tapered hole is not required to retain the inserts in hole 48.

The terms "comprises", "comprising", "includes", "including", "having" and their conjugates mean "including but not limited to".

The term "consisting of means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A cylinder lock providing a safeguard against pull-out of a cylinder of the lock from its housing by a pull-out force applied to the cylinder with a foreign object forcefully entered into a keyway, the cylinder lock comprising:

a housing formed with a cylindrical bore defining an inner surface; and a cylinder within said bore carrying locking elements movable to locking and unlocking positions with respect to said housing;

said cylinder having an outer diameter equal to the diameter of said bore so as to be rotatable when the locking elements are in unlocking position with respect to said housing;

said cylinder being formed with a keyway for receiving a proper key in order to move the locking elements to their locking and unlocking positions with respect to said housing, the keyway sized for receiving the proper key;

characterized in that said cylinder further comprises at least one insert from hardened material movably disposed in at least one groove or hole formed through a surface of the cylinder and extending toward the keyway, wherein the at least one insert is sized to be contained between the keyway and the inner surface defined by the cylindrical bore formed in the housing and is operative to slide out of the at least one groove or hole toward the inner surface defined by the cylindrical bore formed in the housing and forcibly engage or gouge the inner surface defined by the cylindrical bore formed in the housing only in response to forceful entry of a foreign object having a diameter greater than the size of the keyway into the keyway.

2. The lock according to claim 1, wherein the at least one insert is in the form of a disc having an outer facing surface which normally does not protrude outwardly of an outer surface of the cylinder, and an inner facing surface which faces, and communicates with, said keyway such that the urging force extending radially from said keyway urges the inner facing surface of the disc and forces its outer facing surface to protrude outwardly of the outer surface of the cylinder and engage with the inner surface defined by the cylindrical bore formed in the housing.

3. The lock according to claim 2, wherein the outer facing surface of the disc is rounded and has a radius of curvature equal to a radius of curvature of the inner surface defined by the cylindrical bore formed in the housing and concentric thereto.

4. The lock according to claim 2, wherein the at least one insert is shaped such that a mid-portion of the outer facing surface of the disc forcibly engages or gouges an inner surface of the housing in response to an urging force extending radially from said keyway.

5. The lock according to claim 2, wherein the at least one insert is shaped such that an end-portion of said outer facing surface of the disc forcibly engages or gouges the inner surface defined by the cylindrical bore formed in the housing in response to an urging force extending radially from said keyway.

6. The lock according to claim 4, wherein the outer facing surface of disc is rounded and has a radius of curvature equal to or larger than the radius of curvature of the inner surface defined by the cylindrical bore formed in the housing and concentric thereto.

7. The lock according to claim 5, wherein said end-portion of the outer facing surface of the disc is formed with a sharp edge and wherein said sharp edge is configured to cut into the inner surface defined by the cylindrical bore formed in said housing.

8. The lock according to claim 1, wherein the at least one insert is in the form of a disc with a thickness of 0.5-1.2 mm.

9. The lock according to claim 1, wherein the at least one insert is formed from hardened or tempered steel.

10. The lock according to claim 1, wherein the inner surface defined by the cylindrical bore formed in the housing is formed with an annular groove aligned with the at least one insert.

11. The lock according to claim 10, wherein the at least one insert includes an outer facing surface urged into said annular groove by a pair of springs at opposite sides of the at least one insert.

12. The lock according to claim 1, wherein the at least one insert is located at the interface between the outer surface of the cylinder and the inner surface defined by the cylindrical bore formed in the housing aligned with a locking element of the locking elements and serves as a barrier against the penetration of a drill.

13. The lock according to claim 1, wherein said inner surface defined by the cylindrical bore formed in the housing is formed with an annular groove, and the outer surface of said cylinder is formed with an annular groove aligned with the annular groove of the housing; and wherein the at least one insert is ring seated in said annular grooves of the housing and cylinder to overlap an interface between said cylinder and housing and thereby also to serve as an effective barrier against the penetration of a drill through said interface.

14. The lock according to claim 13, wherein said ring is formed with a split at one side and with an inwardly-extending stem in the opposite side seatable in an axially-extending groove formed in an outer surface of the cylinder.

15. The lock according to claim 13, wherein said cylinder includes a plurality of said rings spaced along the length of said cylinder.

16. The lock according to claim 1, wherein the at least one insert extends into the keyway and includes a stem receivable in a shaped slot formed in a proper key.

17. The lock according to claim 16, wherein the at least one insert includes a rounded outer facing surface formed with notches at its opposite ends, such that, upon the introduction of an improper key into the keyway, the at least one insert is moved to cause said notches to protrude outwardly of the cylinder and into grooves formed in the inner surface defined by the cylindrical bore formed in the housing to prevent rotation of the cylinder within the housing.

18. The lock according to claim 17, wherein the at least one insert includes a rounded outer surface formed with notches at its opposite ends, such that, upon the introduction of an improper key into the keyway, the at least one insert is moved to cause said notches to protrude laterally of the cylinder and into grooves formed in the inner surface defined by the cylindrical bore formed in the housing to prevent rotation of the cylinder within the housing.

19. The lock according to claim 1, wherein said cylinder carries a plurality of the at least one spaced along the length of the cylinder.

20. The lock according to claim 19, wherein said plurality of the at least one insert occupies different angular positions of said cylinder.

21. The lock according to claim 1, wherein the at least one insert is located between the entry end of said keyway and a first locking element carried by the cylinder, so as to serve as a barrier against the penetration of a drill.

22. The lock according to claim 1, wherein the at least one insert is sector shaped.

23. The lock according to claim 22, wherein the at least one insert that is sector shaped has an outer facing rounded surface and an inner facing radially-extending stem.

24. The lock according to claim 1, wherein said at least one hole extends between an outside surface of said cylinder and said keyway.

25. The lock according to claim 24, wherein said at least one hole comprises a plurality of holes positioned at oblique angles on the surface of said cylinder.

26. The lock according to claim 24, wherein said at least one hole is sized and shaped to form a friction fit with the at least one insert.

27. The lock according to claim 24, wherein the at least one insert is cylindrical shaped, pyramid shaped, cylindrical shaped with a head wider than a diameter of said cylinder, or hexagonal shaped.

28. The lock according to claim 24, wherein the at least one insert of a hard material comprises two parts.

29. The lock according to claim 28, wherein one of said two parts is a ball and the other of said two parts is a cylinder.

30. The lock according to claim 1, wherein the at least one insert is configured to resist penetration of a drill bit into the cylinder through the at least one insert.

31. The lock according to claim 1, wherein the at least one insert is configured to be displaced outward from the at least one groove or hole and to forcibly engage or gouge the inner surface of the housing in response to forceful entry of a screw or a drill bit into the keyway.

* * * * *